US009458702B1

(12) United States Patent
Derouen, Sr.

(10) Patent No.: US 9,458,702 B1
(45) Date of Patent: Oct. 4, 2016

(54) METHOD AND APPARATUS FOR CATCHING AND RETRIEVING OBJECTS IN A RISER ASSEMBLY

(71) Applicant: 5D I.P., L.L.C., Eunice, LA (US)

(72) Inventor: Mark W. Derouen, Sr., Eunice, LA (US)

(73) Assignee: 5D Oilfield Magnetics IP Pressure Systems, LLC, Eunice, LA (US)

( * ) Notice: Subject to any disclaimer, the term of this patent is extended or adjusted under 35 U.S.C. 154(b) by 0 days.

(21) Appl. No.: 14/744,809

(22) Filed: Jun. 19, 2015

Related U.S. Application Data

(60) Provisional application No. 62/015,069, filed on Jun. 20, 2014.

(51) Int. Cl.

| | |
|---|---|
| ***E21B 31/06*** | (2006.01) |
| ***E21B 17/00*** | (2006.01) |
| ***E21B 37/00*** | (2006.01) |
| ***E21B 23/00*** | (2006.01) |
| ***E21B 41/00*** | (2006.01) |
| ***E21B 17/01*** | (2006.01) |

(52) U.S. Cl.
CPC ..... *E21B 41/0021* (2013.01); *E21B 17/01* (2013.01)

(58) Field of Classification Search
None
See application file for complete search history.

(56) References Cited

U.S. PATENT DOCUMENTS

| | | | | |
|---|---|---|---|---|
| 3,089,724 | A * | 5/1963 | Crooks | E21B 31/06 175/308 |
| 4,244,424 | A * | 1/1981 | Talbot | H01F 7/0215 166/66 |
| 9,394,755 | B1 * | 7/2016 | DeRouen, Sr. | E21B 31/06 |
| 2012/0006554 | A1 * | 1/2012 | Allen | B08B 1/008 166/338 |
| 2013/0020096 | A1 * | 1/2013 | DeRouen, Sr. | E21B 31/06 166/382 |
| 2013/0153303 | A1 * | 6/2013 | Angelle | E21B 12/06 175/84 |
| 2014/0083676 | A1 * | 3/2014 | Miner | E21B 19/24 166/85.5 |

* cited by examiner

*Primary Examiner* — Matthew R Buck
*Assistant Examiner* — Douglas S Wood
(74) *Attorney, Agent, or Firm* — Ted M. Anthony

(57) ABSTRACT

A riser magnet assembly having selectively removable magnet members can be incorporated within a riser assembly of a drilling rig to generate a magnetic field within a central bore of the riser assembly. The magnetic field catches falling metal objects and prevents such objects from passing beyond the magnet assembly and entering subsea equipment or subterranean portions of a wellbore without sacrificing fluid pressure integrity of the riser assembly. At least one stripper door is provided for easy access to inner portions of the magnet assembly.

2 Claims, 10 Drawing Sheets

METHOD AND APPARATUS FOR CATCHING AND RETRIEVING OBJECTS IN A RISER ASSEMBLY

CROSS REFERENCES TO RELATED APPLICATION

This application claims priority of U.S. Provisional patent application Ser. No. 62/015,069, filed Jun. 20, 2014, incorporated herein by reference.

STATEMENTS AS TO THE RIGHTS TO THE INVENTION MADE UNDER FEDERALLY SPONSORED RESEARCH AND DEVELOPMENT

NONE

BACKGROUND OF THE INVENTION

1. Field of the Invention

The present invention pertains to a method and apparatus for preventing unwanted objects from entering portions of a wellbore. More particularly, the present invention pertains to the use of magnetic field(s) to catch unwanted objects within a wellbore. More particularly still, the present invention pertains to an apparatus for generating magnetic field(s) between a rig floor of a rig and a wellhead, such as in a marine riser assembly, in order to prevent unwanted ferrous objects from entering a wellbore below said wellhead.

2. Brief Description of the Prior Art

Objects can sometimes accidentally fall into the uppermost opening of a well from above including, without limitation, from the rig floor surrounding said opening. In other instances, objects can be purposely thrown or dropped into a well as an intentional act of sabotage. If such objects are not stopped before entering the subterranean portion of the wellbore, the objects can prevent downhole equipment from functioning properly and can often impede the drilling and/or completion process.

Relatively large objects can generally be retrieved from a wellbore using specially designed "fishing tools." Such fishing tools are lowered into a wellbore and connect to a dropped object within the wellbore. Thereafter, the fishing tools and the connected object can both be safely retrieved from the wellbore. In many instances, the retrieval process for such large objects can be relatively simple because the size of the objects enables such objects to be grasped and lifted out of the wellbore. In oil and gas operations there is usually significant expense associated with having to use fishing tools.

By contrast, relatively small objects dropped in a wellbore—and particularly ferrous metal objects—can often cause the most disruption to downhole equipment and related operations. For example, during completion operations, small pieces of metal present in a wellbore can prevent packers and other completion tools from sealing against a casing wall. During open hole drilling operations, such small metal objects can destroy very expensive downhole equipment such as Polycrystalline Diamond Compact (PDC) bits.

Such small objects can also be very difficult to retrieve from a wellbore, as they are often too small to be grasped using conventional fishing tools. This is especially true for small metal objects and, in particular, small metal objects that have an irregular shape or small pieces that can be broken up during the retrieval process. Unfortunately, drilling rigs typically have many small metal objects (such as, for example, wrenches, chain, bolts, tong dies and nuts) at or near the rig floor. Such objects, which are in relatively close proximity to the upper opening of a well, are at risk of falling into a wellbore.

As noted above, such relatively small metal objects can cause significant disruptions to downhole operations. Further, fishing operations for small metal objects can be very time consuming and, as a result, very costly. Accordingly, the best way to prevent such disruptions and to avoid long and expensive fishing operations for such small objects is to keep such objects from entering a wellbore in the first place.

Rig operating procedures frequently dictate that when no pipe is present in a wellbore that blind rams in a blowout preventer ("BOP") assembly be closed in order to block access to subterranean portion of said wellbore and keep any unwanted falling objects from entering said wellbore from above the BOP assembly. If an object is dropped into a well at the rig floor, with such BOP blind rams closed, the object will not fall all the way into the subterranean portion of a wellbore.

However, this solution is less than optimal, because the object must still be retrieved from the top of the blind rams before operations can resume. Such retrieval process typically requires draining such BOP assembly of fluids to locate the object, opening the bonnet in the BOP assembly, finding and retrieving the object, and then closing and retesting the BOP assembly to the required test pressures. This retrieval process—while frequently quicker and less expensive than fishing the item from the bottom of the well—is nonetheless still relatively expensive, time consuming and dangerous for personnel.

Thus, there is a need for an apparatus and method for catching dropped objects, and particularly metallic objects, before such objects enter the subterranean portion of a well. Such apparatus and method should prevent dropped objects from falling further into a wellbore, and should hold such objects for ultimate retrieval and removal from a wellbore. As an added benefit, such apparatus should also allow for the removal of metallic debris from well fluids.

SUMMARY OF THE PRESENT INVENTION

The present invention comprises an apparatus for generating a magnetic field that can be attached to, placed in the vicinity of, or made a part of a marine riser. The magnetic field is used to catch falling metal and/or magnetic objects and keep them from passing beyond the slip joint in a marine riser assembly and entering the subterranean portions of a wellbore. Said magnetic field can also catch ferrous metallic and/or other magnetic objects and debris present in well fluids, and permit easy and efficient removal thereof.

A magnet assembly of the present invention comprises at least one magnet and is disposed on, around, or as an integral part of a wellbore. The magnet(s) of the magnet assembly of the present invention can be sized based on the internal diameter of a wellbore, as well as the ability to catch certain representative objects that have been dropped into or fished out of wellbores.

In the preferred embodiment, the magnet assembly of the present invention can be mounted as part of a riser assembly. Typically, the magnet assembly of the present invention can be installed within a riser assembly situated between a subsea wellhead and a floating drilling vessel—that is, in the portion of the riser assembly below the floating drilling vessel but above a subsea wellhead.

The magnets of the present invention are mounted and can be selectively moved away from a wellbore when desired.

For example, it may be beneficial to selectively move said magnets away from said wellbore to prevent magnetic interference with logging tools or other equipment that may be sensitive to magnetic fields, or when circulating large concentrations of metallic debris in a rig fluid system (such as, for example, when milling up stuck metal objects in a well). Movement of said magnets can be manually performed, or remotely actuated using pneumatic or hydraulic powered assemblies.

In the preferred embodiment, the magnet assembly of the present invention comprises a central body member defining an internal chamber, as well as an inlet and outlet in communication with said internal chamber. A single hinged and recessed stripper door allows selective access into said internal chamber. Hinged magnet members, which can be partially received within recesses formed in the sides of said central body member (including said stripper door), are mounted in proximity to said hinged stripper door. Further, said hinged magnet members and stripper door can be selectively positioned relative to one another.

Importantly, the magnet assembly of the present invention is capable of maintaining a fluid pressure seal within said central body member when said stripper door is closed and secured. As a result, the magnet assembly of the present invention can withstand and contain fluid pressures normally observed within a marine drilling or completion riser assembly. Put another way, the magnet assembly of the present invention can be included within a marine drilling or completion riser assembly without compromising or limiting the fluid pressure integrity of said riser assembly.

The apparatus of the present invention can be disposed at virtually any location(s) between a rig floor of a drilling or completion rig, and a wellhead assembly of a well. In a preferred embodiment, said apparatus can be conveniently and effectively located as part of a marine drilling or completion riser assembly on a floating drilling rig and still permit access to remove objects that have been captured above the water line (that is, the upper water surface). This access above the water line is less expensive, safer, limits environmental impact, and faster than a subsea retrieval process.

Alternative embodiments of magnet assemblies (for use primarily in connection with a bell nipple of a non-floating drilling vessel) are disclosed in U.S. Non-Provisional patent application Ser. No. 13/553,915, filed Jul. 20, 2012 and entitled "Method and Apparatus for Catching and Retrieving Objects in a Well", as well as U.S. Non-Provisional patent application Ser. No. 13/873,718, filed Apr. 30, 2013 entitled "Method and Apparatus for Catching and Retrieving Objects in a Well", both of which are incorporated herein by reference for all purposes.

BRIEF DESCRIPTION OF THE DRAWINGS

The foregoing summary, as well as the following detailed description of the preferred embodiments, is better understood when read in conjunction with the appended drawings. For the purpose of illustrating the invention, the drawings show certain preferred embodiments. It is understood, however, that the invention is not limited to the specific methods and devices disclosed. Further, dimensions, materials and part names are provided for illustration purposes only and not limitation.

DETAILED DESCRIPTION OF A PREFERRED EMBODIMENT OF THE INVENTION

Figure 1:
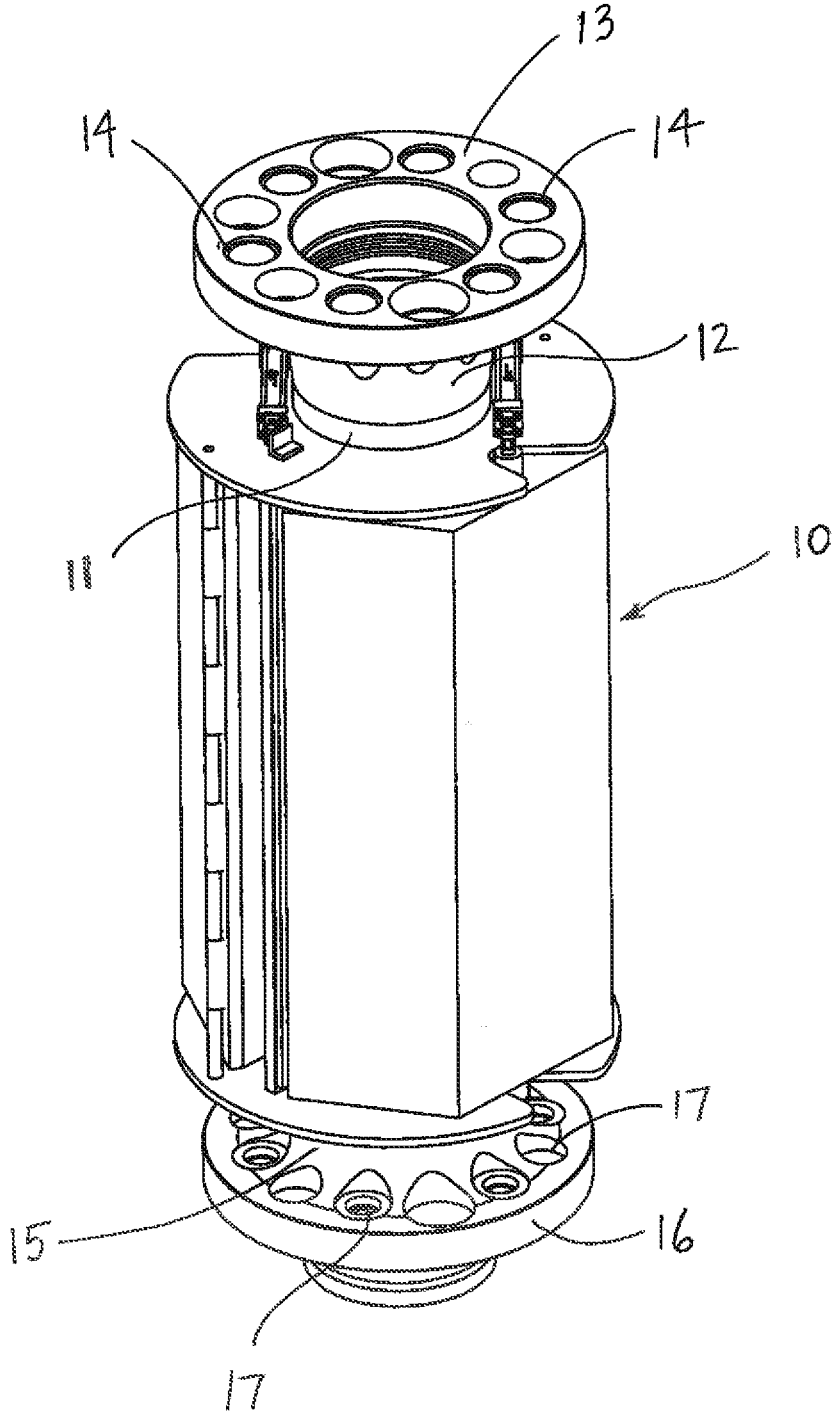
FIG. 1 depicts a side perspective view of a riser magnet assembly of the present invention in a closed configuration.

Referring to the drawings, FIG. 1 depicts an overhead perspective view of a riser magnet assembly 10 of the present invention in a closed configuration. Generally, said riser magnet assembly 10 of the present invention can be installed in relatively close proximity to the upper opening of a wellbore (such as, for example, integrated into a riser assembly of a floating drilling vessel). Said riser magnet assembly 10 generates a magnetic field that is beneficially directed inwardly toward the inner central bore of a riser assembly in order to catch falling magnetic (such as, for example, ferrous or metallic) objects and prevent such objects from entering a subterranean portion of said wellbore, as more fully described herein.

Still referring to FIG. 1, riser magnet assembly 10 comprises central body member 11. As depicted in FIG. 1, said central body 11 (together with cooperating elements described herein) comprises a substantially hollow enclosure having an internal chamber that defines an inner volume. However, it is to be observed that central body 11 can exhibit many different shapes or configurations while remaining functional and without departing from the scope of the present invention as set forth herein.

Upper connection member 12 having flange 13 extends from the upper surface of central body member 11. Flange 13 further comprises a plurality of holes or apertures 14 for receiving threaded bolts or other similar fasteners, as well as to provide openings for control line conduits. Lower connection member 15 having flange 16 extends from the bottom surface of said central body member 11. Flange 16 further comprises a plurality of holes or apertures 17 for receiving threaded bolts or other similar fasteners, as well as to provide openings for control line conduits. Said upper connection member 12 and lower connection member 15 are axially aligned with one another, and both open into and are in communication with the inner chamber of central body member 11 as described in more detail below.

In the preferred embodiment depicted in FIG. 1, said upper connection member 12 and lower connection member 15 each have a central through bore. The central bores of upper connection member 12 and lower connection member 15 are in substantial axial alignment and fluid communication with the internal chamber of central body member 11.

Although said riser magnet assembly 10 can be installed within a wellbore in many different configurations, in the preferred embodiment said riser magnet assembly 10 can be installed as part of a well's riser assembly above a subsea wellhead and BOP assembly. In this manner, said riser magnet assembly 10 can be installed "in-line" such as, for example, with upper flange member 13 and lower flange member 16 being operationally attached to flange connections of riser members as part of a riser assembly.

Figure 2:
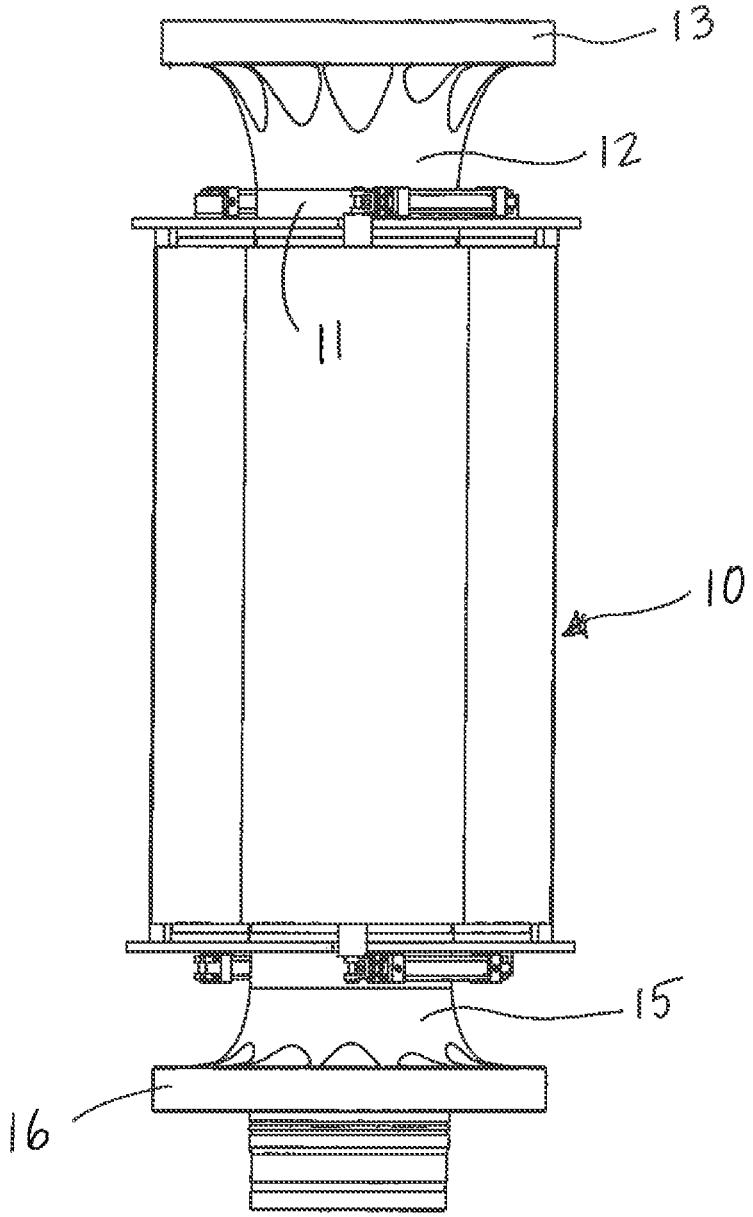
FIG. 2 depicts a side view of a riser magnet assembly of the present invention in a closed configuration.
Figure 3:
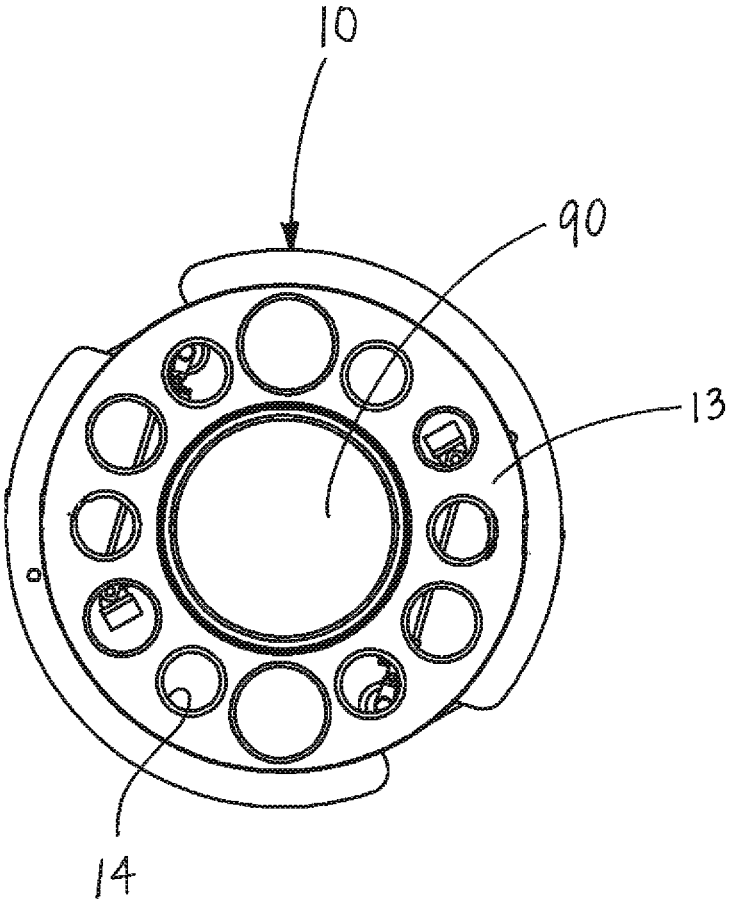
FIG. 3 depicts a top view of a riser magnet assembly of the present invention in a closed configuration.

FIG. 2 depicts a side view of a riser magnet assembly 10 of the present invention in a closed configuration, while FIG. 3 depicts an overhead view of a riser magnet assembly 10 of the present invention in a closed configuration. FIG. 2 depicts a central body member 11 which defines a substantially hollow tubular enclosure defining an internal chamber having a volume. Upper connection member 12 extends from the upper surface of central body member 11.

Referring to FIG. 3, it is to be observed that an unobstructed bore 90 defining a flow path is formed through riser magnet assembly 10. Specifically, said bore and flow path extends through upper connection member 12, central body member 11 and lower connection member 15. As such, when said riser magnet assembly 10 is installed "in-line" within a riser assembly of a floating drilling vessel, an unobstructed passage way and a direct flow path is formed through bore 90 of said riser magnet assembly 10.

Figure 4:
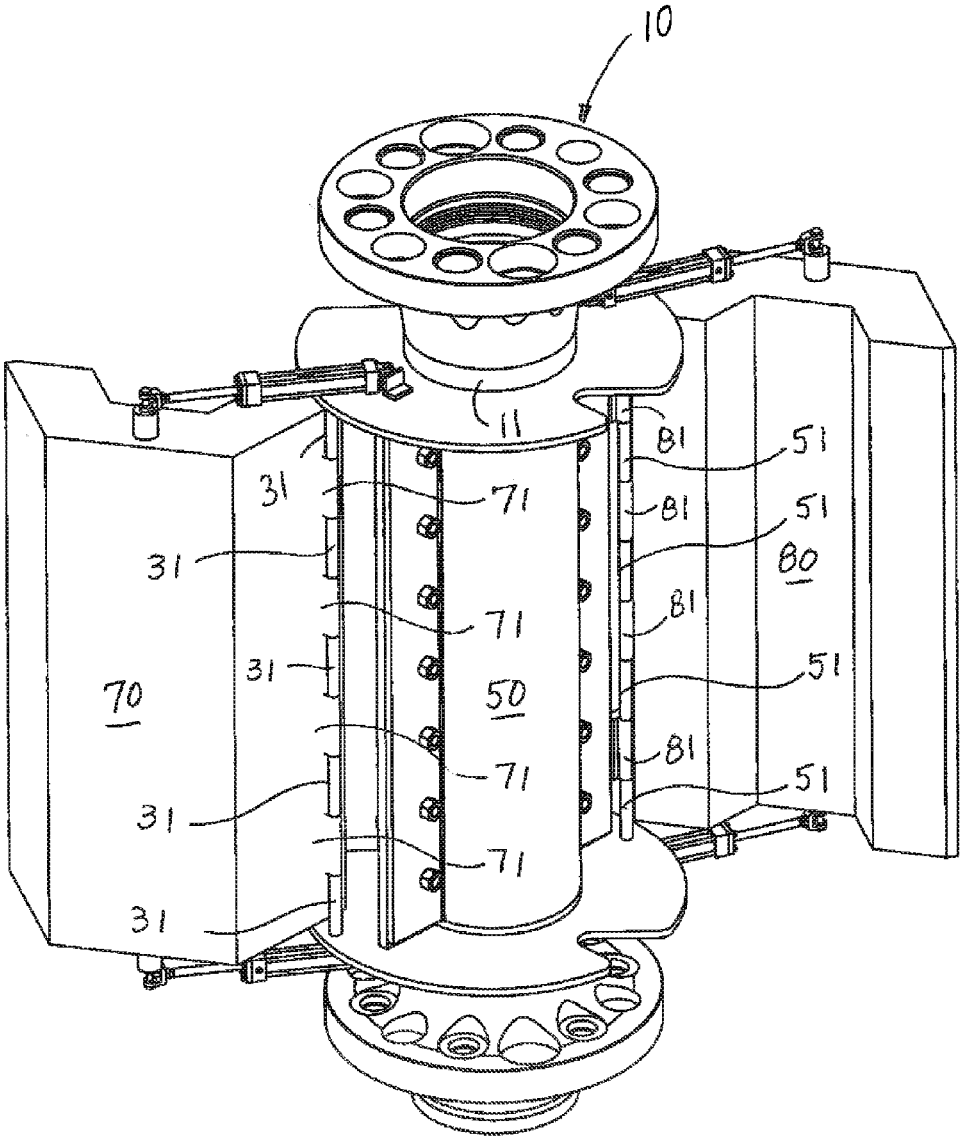
FIG. 4 depicts a side perspective view of a riser magnet assembly of the present invention with magnet members in an open configuration.
Figure 5:
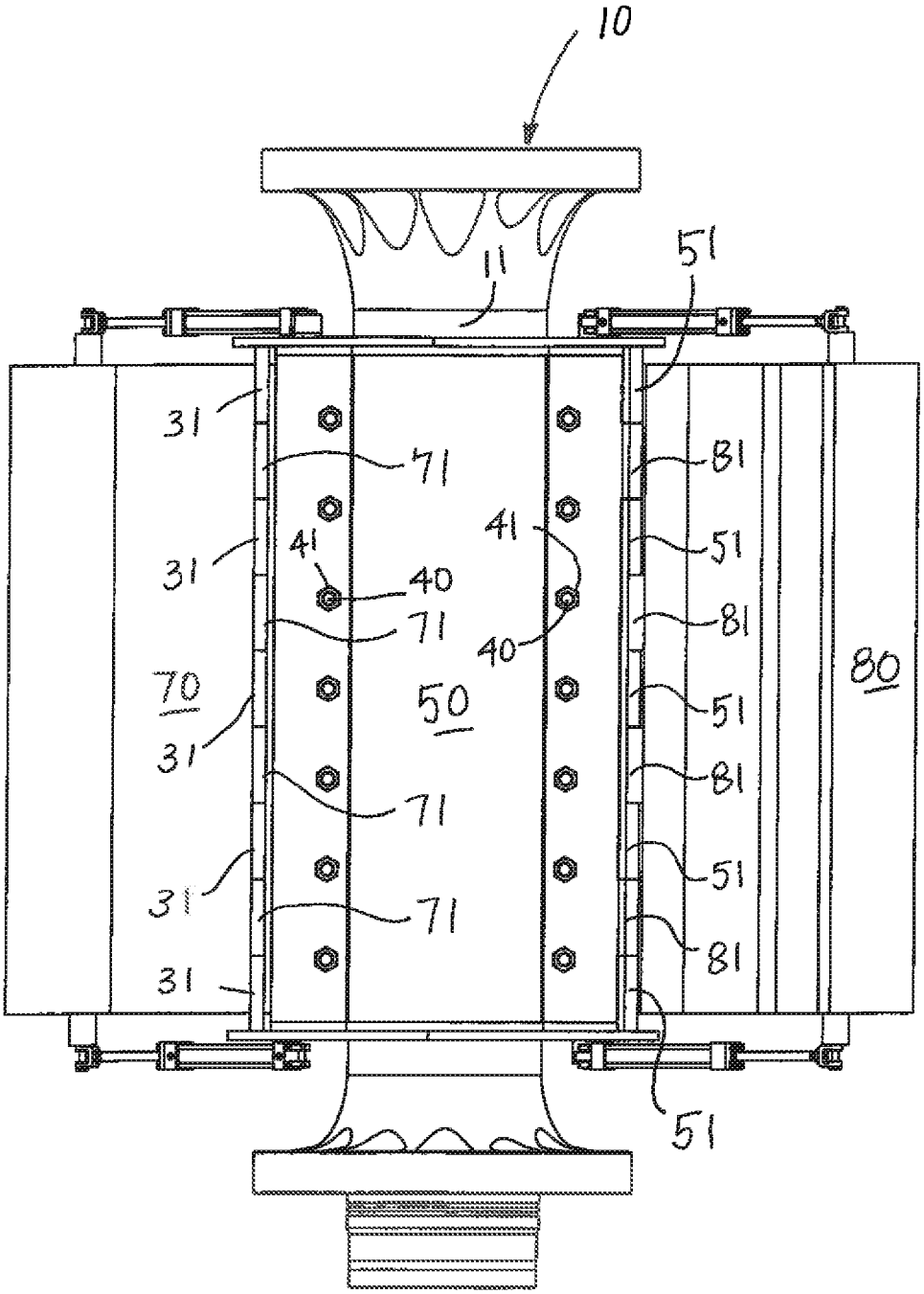
FIG. 5 depicts a side view of a riser magnet assembly of the present invention with magnet members in an open configuration.
Figure 6:
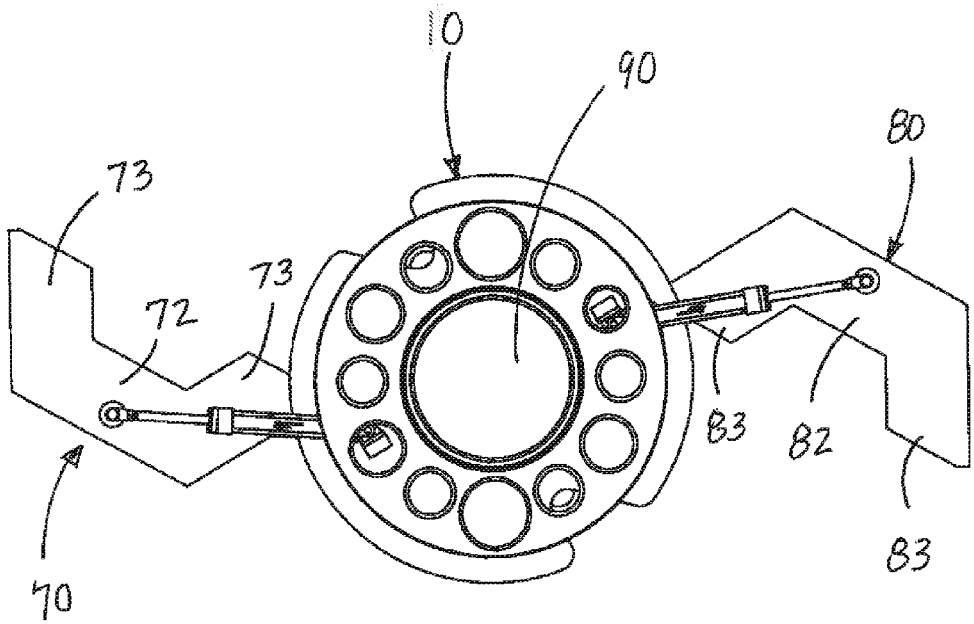
FIG. 6 depicts an overhead view of a riser magnet assembly of the present invention with magnet members in an open configuration.

FIG. 4 depicts a side perspective view of a riser magnet assembly 10 of the present invention with a stripper door 50 in a closed and locked position, and first magnet member 70 and second magnet member 80 in a substantially open configuration. Similarly, FIG. 5 depicts a side view of a riser magnet assembly 10 of the present invention with stripper door 50 in a closed and locked position and first magnet member 70 and second magnet member 80 in an open configuration. FIG. 6 depicts top view of a riser magnet assembly 10 of the present invention with first magnet member 70 and second magnet member 80 in an open configuration.

Referring to FIGS. 4 and 5, first magnet member 70 and second magnet member 80 are connected to central body member 11 using hinge assemblies. On one lateral side of riser magnet assembly 10, first magnet member 70 is hingeably attached to central body member 11. Specifically, magnet hinge members 71 of first magnet member 70 is pivotally connected to body hinge body members 31 using a hinge pin disposed through said aligned magnet hinge body members 71 and body hinge body members 31. Said hinge assembly permits said first magnet member 70 to swing away or outward relative to body member 11, about an axis passing through said aligned hinge body members.

On the opposite lateral side of riser magnet assembly 10, a hinge assembly comprises magnet hinge body members 81 of second magnet member 80 pivotally connected to stripper door hinge body member members 51 using a hinge pin disposed through said aligned magnet hinge body members 81 and stripper door hinge body member members 51. Said hinge assembly permits stripper door member 50 to open or swing outward relative to body member 11 about an axis passing through said hinge assembly. Further, it is to be observed that said stripper door 50 and second magnet member 80 can hingeably swing independently from one another other.

When said stripper door 50 is closed and secured as depicted in FIGS. 4 and 5, an inner chamber is formed by cooperation between central body 11 and said stripper door 50 as described more fully below. Thus, when said stripper door 50 is opened, said stripper door 50 allows selective access into said inner chamber formed within said inner chamber.

Still referring to FIG. 5, stripper door 50 is closed and secured in place relative to body 11 using a plurality of threaded bolts 40 and nuts 41, while first magnet member 70 and second magnet member 80 are pivotally extended (that is, swung open) relative to said stripper door 50 and body 11. When in a closed and secured position, stripper door 50 can form a fluid pressure seal with body 11 of riser magnet assembly 10.

Figure 7:
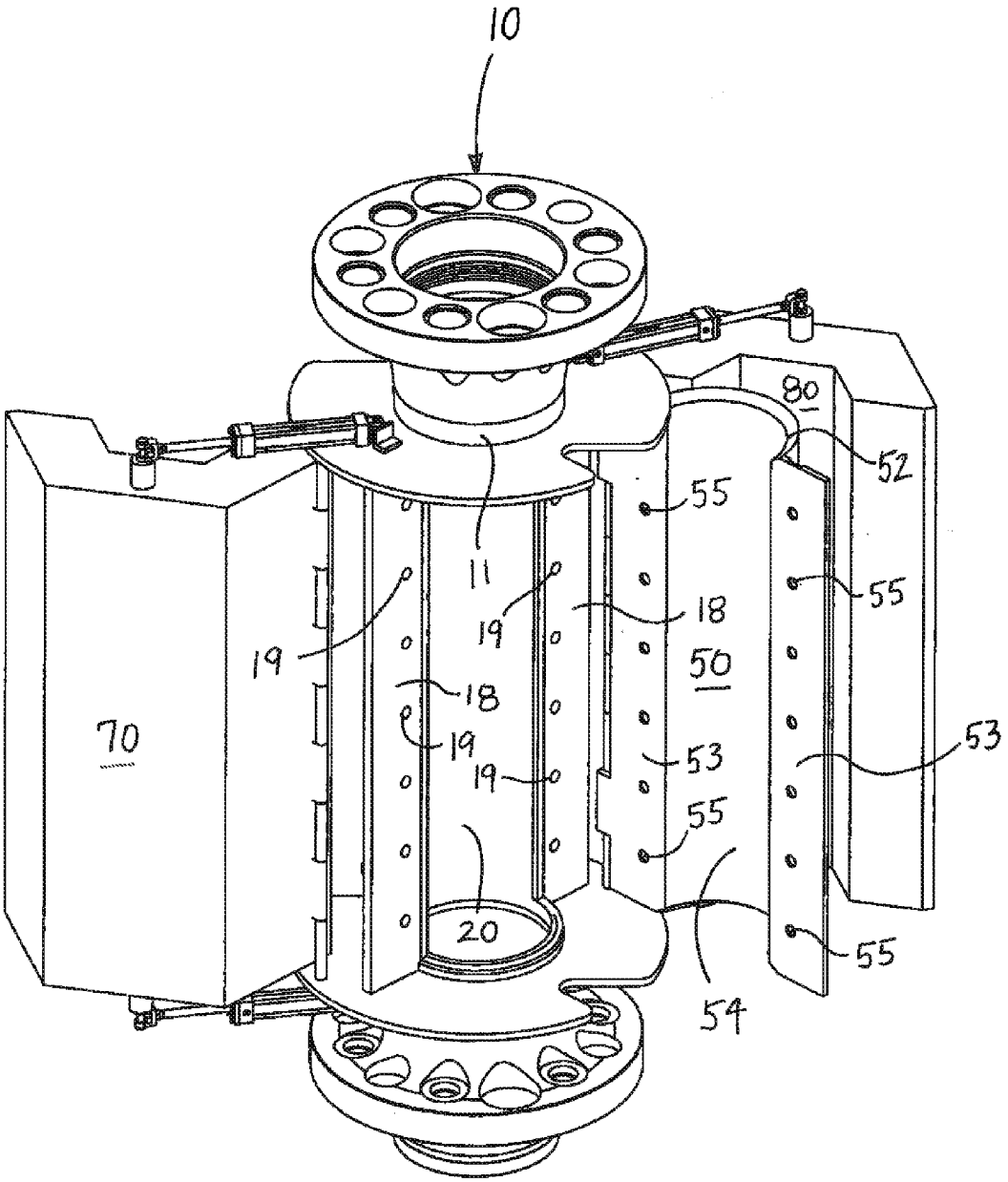
FIG. 7 depicts a side perspective view of a riser magnet assembly of the present invention with magnet members in an open configuration and a stripper door in a partially open configuration.
Figure 10:
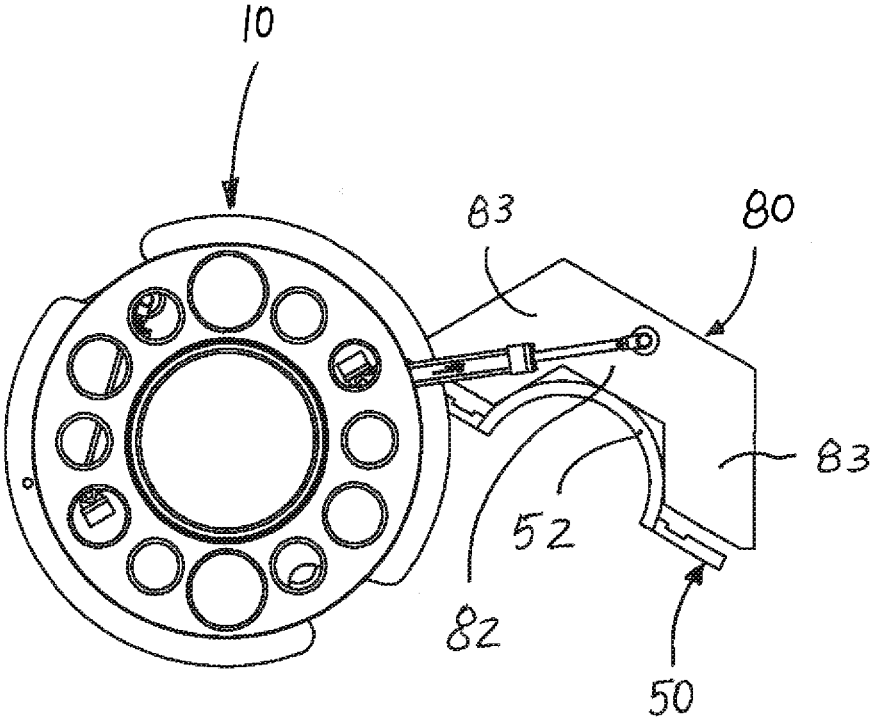
FIG. 10 depicts an overhead view of a riser magnet assembly of the present invention with a magnet member and a stripper door in a substantially open configuration.

Referring to FIG. 7, in a preferred embodiment, stripper door member 50 has central semi-cylindrical body section 52 (having a convex outer surface) flanked by substantially planar side or wing members 53. Said stripper door member 50, as well as magnet members 70 and 80, can open and close independently of each other. As shown in FIG. 10, when said magnet member 80 and stripper door 50 are joined together, shaped magnet member 80 (and, more particularly, central section 82 and side members 83) generally conform to the outer surface of said stripper door 50. In this position, body section 52 of stripper door 50 is partially subsumed within concave area formed by second magnet member 80.

FIG. 6 depicts an overhead view of a riser magnet assembly 10 of the present invention with magnet members 70 and 80 in an open or extended position. First magnet member 70 is pivotally extended or swung open relative to central bore 90, while second magnet member 80 is pivotally extended or swung open relative to said central bore 90.

In a preferred embodiment of the present invention, said magnet members 70 and 80 comprise rare earth or ceramic magnets exhibiting desired magnetic characteristics (that is, creating their own persistent magnetic fields). Further, in the preferred embodiment, each of said magnet members 70 and 80 forms a substantially U-shaped configuration. Accordingly, referring to FIG. 6, first magnet member 70 generally comprises a concave central section 72 flanked by side members 73, while second magnet member 80 generally comprises a concave central section 82 flanked by side members 83. When said magnet members are in a closed position, said configuration of magnet members 70 and 80 helps to surround central bore 90, while focusing the magnetic field(s) generated by said magnet members 70 and 80 toward said central bore 90.

As depicted in FIG. 6, magnet members 70 and 80 of said riser magnet assembly 10 can be selectively opened away from the central axial through-bore 90 formed through riser magnet assembly 10 when desired. For example, it may be beneficial to selectively move said magnets members 70 and 80 away from central axial through-bore 90 of riser magnet assembly 10 to prevent magnetic interference with logging tools or other equipment that may be sensitive to magnetic fields, or when circulating large concentrations of metallic debris in a rig mud system (such as, for example, when milling up stuck metal objects in a well).

Figure 8:
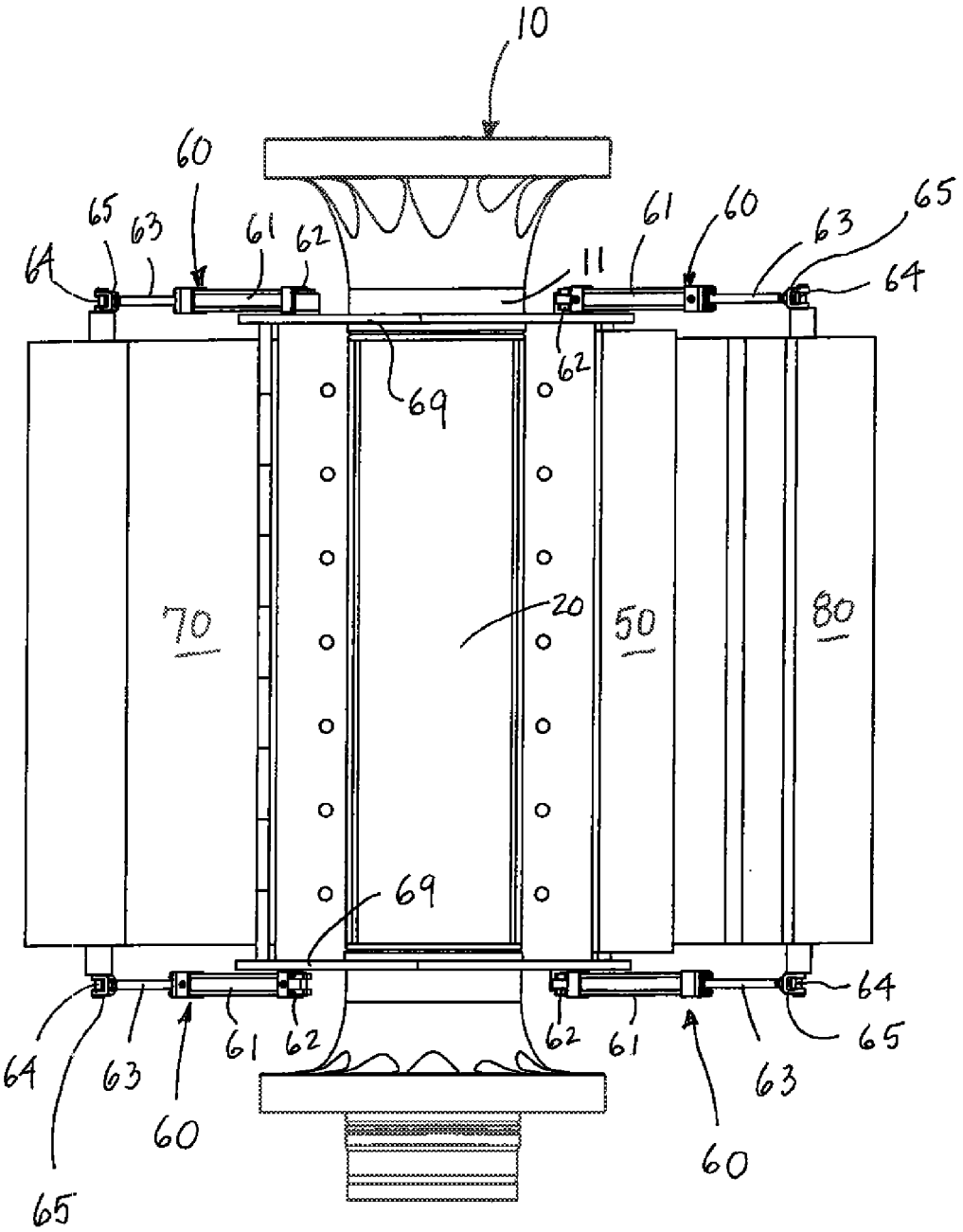
FIG. 8 depicts a side view of a riser magnet assembly of the present invention with magnet members in an open configuration and a stripper door in a partially open configuration.

FIG. 7 depicts a side perspective view of a riser magnet assembly 10 of the present invention with magnet members 70 and 80 in an open or spread configuration and stripper door 50 in a partially open configuration. FIG. 8 depicts a side view of said riser magnet assembly 10 of the present invention with magnet members 70 and 80 in an open or spread configuration and stripper door 50 in a partially open configuration. As depicted in FIGS. 7 and 8, said stripper door member 50 can be selectively opened to provide access to the internal chamber formed within central body 11.

Referring to FIG. 7, central body member includes semi-cylindrical section defining inner surface 20. Stripper door member 50 generally comprises central semi-cylindrical body section 52 (defining concave inner surface 54) flanked by substantially planar side members 53. A plurality of apertures or transverse fastener holes 55 extend through said side members 53. Central body member 11 further comprises substantially planar side members 18 having a plurality of apertures or transverse fastener holes 19 extending through said side members 18.

When stripper door 50 is in a closed position (as depicted in FIG. 4), side members 53 are positioned in substantially mating relationship with side members 18 of body member 11, with holes 55 and 19 substantially aligned. It is to be observed that gasket members or elastomeric sealing members may optionally be disposed between said side members 18 and 53 to further facilitate a fluid pressure seal between stripper door 50 and body 11. When closed and secured, stripper door 50 and central body member 11 can provide a fluid pressure seal sufficient to withstand expected pressures observed in a drilling riser in which riser magnet assembly 10 is incorporated.

Referring back to FIG. 5, it is to be observed that a plurality of threaded bolts 40 can be received within said aligned holes 55 and 19 (said holes 55 and 19 shown in FIG. 7), and secured in place using nuts 41. Referring to FIG. 7, with stripper door 50 closed and secured against central body member 11, semi-cylindrical inner surface 20 of central body member 11 is disposed in opposing relationship with inner surface 54 formed by body section 52 of stripper door 50. Opposing cylindrical inner surface 20 of central body member 11 and inner surface 54 of stripper door 50 cooperate to form a substantially cylindrical bore extending through riser magnet assembly 10.

Referring to FIG. 6, in this configuration an unobstructed path is formed through riser magnet assembly 10—that is, an open and unobstructed bore 90 extends through riser magnet assembly 10 via aligned upper connection member 12, central body member 11 and lower connection member 15 (not visible in FIG. 6), for the passage of tools or equipment, as well as the flow of fluid.

Figure 9:
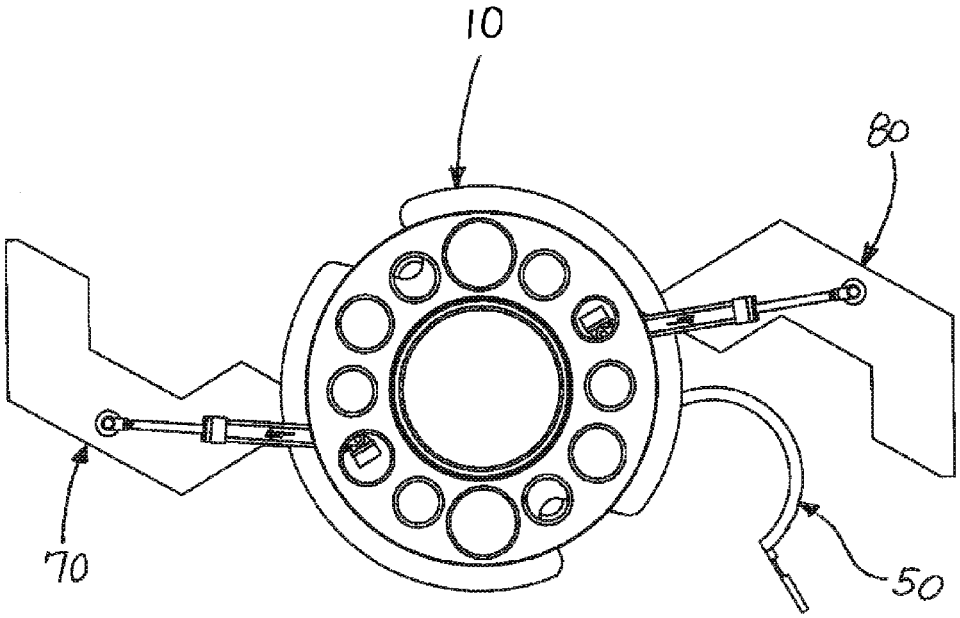
FIG. 9 depicts an overhead view of a riser magnet assembly of the present invention with magnet members in an open configuration and a stripper door in a partially open configuration.

FIG. 9 depicts an overhead view of a riser magnet assembly 10 of the present invention with magnet members 70 and 80 in an open configuration and stripper door 50 in a partially open configuration. Stripper door member 50 and second magnet member 80 can hingeably open and close independently of each other. As such, as depicted in FIG. 3, when stripper door 50 is closed and secured to body member 11, and first magnet member 70 and second magnet member 80 are inwardly closed, said magnet members 70 and 80 are beneficially positioned proximate to said central through-bore 90.

FIG. 10 depicts an overhead view of riser magnet assembly 10 of the present invention with a magnet member 80 and a stripper door 50 in a substantially open position. In this configuration, central semi-cylindrical body section 52 of stripper door 50 is generally received within substantially U-shaped or concave magnet member 80 (wherein said concavity is formed by central section 82 and side members 83).

Although specific equipment configurations can vary, a drilling riser generally comprises a conduit that connects a floating drilling vessel (floating on the surface of a body of water) to the upper opening of a well (typically via a subsea blowout preventer assembly and subsea wellhead assembly which are disposed on the sea floor). Many such risers comprise a plurality of flanged tubular sections that are bolted together or otherwise joined to make a continuous string having a desired length. The riser acts as a "funnel" to guide drilling tools into and out of the upper opening of a wellbore.

Unfortunately, not all objects that a riser guides into a wellbore are beneficial. If unwanted falling objects are not stopped before entering the subsea assemblies and/or subterranean portion of a wellbore, such objects can prevent downhole equipment from functioning properly and can often negatively impede the drilling process as detailed herein.

Referring to FIG. 3, riser magnet assembly 10 of the present invention, and more particularly magnet members 70 and 80 thereof (not visible in FIG. 3), create an inwardly directed magnetic field. In the preferred embodiment, said magnetic field is generally focused or directed toward central through-bore 90 of said riser magnet assembly, which is in alignment with said wellbore. As a result, metallic or ferrous objects dropped into the upper opening of a drilling riser are caught in said magnetic field and do not enter the subterranean portions of a wellbore. Such objects can be easily retrieved from riser magnet assembly 10.

As noted above, in certain circumstances, it may be beneficial to selectively position said magnets members 70 and 80 temporarily away from central through bore 90 of riser magnet assembly 10 in order to prevent magnetic interference with logging tools or other equipment that may be run into a well equipped with riser magnet assembly 10. Similarly, it may also be beneficial to selectively position said magnets members 70 and 80 temporarily away from central through bore 90 when circulating large concentrations of metallic debris in a rig mud system (such as, for example, when milling up stuck metal objects in a well) in order to prevent clogging of riser magnet assembly 10. Notwithstanding the foregoing, in other circumstances, it is highly beneficial to remove metallic particles or debris from wellbore fluids at a riser using riser magnet assembly 10. If metal from the wellbore travels through the surface system it gets grounded up by the surface mud treating and pumping equipment and will be very difficult to remove in the future circulations.

Referring to FIG. 8, first magnet member 70 and second magnet member 80 can be selectively opened away from inner surface 20 of central body member 11 using fluid powered cylinder assemblies 60. Said fluid powered cylinder assemblies 60, which are typically powered using hydraulic fluid, generally comprise cylinder barrels 61, each of which are pivotally mounted to a mounting plate 69 using a pivot pin 62. A piston rod 63 can extend or retract relative to each of said cylinder barrels 61. The distal end of each piston rod 63 is pivotally attached to a pivot pin 64 on a magnet member (either 70 or 80) using clevis bracket 65. By selectively actuating a pair of cylinder assemblies 60, a magnet member 70 or 80 can be selectively swung open or closed; specifically, extension of piston rods 63 can cause an attached magnet member to swing outward or open, while retraction of said piston rods can cause an attached magnet member so swing inward or close. Although not depicted in FIG. 8, it is to be observed that fluid powered cylinder assemblies 60 can be operationally connected to fluid pumps, reservoirs, accumulators or other equipment, typically supplied via conduits or flow lines.

In many cases, milling of downhole equipment or other wellbore operations can generate metallic shavings, particles or other debris supported in drilling mud or other fluid within a wellbore. Although efforts are made on virtually all rigs to remove debris and contaminants from drilling mud or other fluids, over time such metallic shavings, particles and/or debris can reach significant concentrations in such drilling mud or other fluids. Such metallic content can adversely affect fluid properties, equipment performance and/or operational effectiveness. Thus, it is generally beneficial to remove such metallic materials from such drilling mud or other fluids.

Thus, although riser magnet assembly 10 of the present invention can be used to catch falling objects, said riser magnet assembly 10 can also serve the function of catching undesirable metallic materials from drilling mud or other fluid. Such metallic material materials can often attach to the internal surface of stripper door 50. Moreover, any such metallic material can be recovered and measured, which can frequently provide valuable insight into ongoing operations within a well.

Any drilling mud or other fluid can be drained from inside riser magnet assembly 10 via a drain port. Stripper door 50 can be opened completely to provide access into the inner chamber of a central body member 11 (including, without limitation, inner surface 20 thereof); as seen from the embodiment depicted herein, said stripper door 50 can be unbolted in order to be opened. In most instances, stripper door 50 and magnet members 70 and 80 are not opened simultaneously in order to prevent possible loss of magnetic forces on a caught object, particularly if such object spans substantially across the width of riser magnet assembly 10. Once the caught object is removed, said stripper door 50 can be closed and bolted in place. Thereafter, drilling or other operations can be resumed.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A magnet assembly adapted to be incorporated within a riser assembly of a floating vessel for catching objects falling into said riser assembly comprising:

a) a body member;

b) a door member hingeably connected to said body member, wherein said door member can be selectively alternated between a first closed position and a second open position, and wherein said body member and said door member can cooperate to form an inner chamber having a substantially unobstructed flow path, and a fluid pressure seal between said body member and said door member, when said door member is in said first closed position;

c) a first magnet hingeably attached to said central body member; and d) a second magnet hingeably attached to said central body member.

2. The magnet assembly of claim 1, wherein said first magnet is adapted to alternate between a first position adjacent to said inner chamber and a second position away from said inner chamber, said second magnet is adapted to alternate between a first position adjacent to said inner chamber and a second position away from said inner chamber, and said first and second magnets substantially surround said inner chamber when said first and second magnets are in said first positions.

* * * * *